US006477789B2

(12) United States Patent
Cheng

(10) Patent No.: US 6,477,789 B2
(45) Date of Patent: Nov. 12, 2002

(54) VENTILATED SHOE INSOLE HAVING MINIMAL HEIGHT FRONT REGION

(76) Inventor: Peter Cheng, 99 Glencairn Street, Toronto, Ontario (CA), M4R 1M7

( * ) Notice: Subject to any disclaimer, the term of this patent is extended or adjusted under 35 U.S.C. 154(b) by 0 days.

(21) Appl. No.: 09/730,060

(22) Filed: Dec. 5, 2000

(65) Prior Publication Data

US 2002/0066207 A1 Jun. 6, 2002

(51) Int. Cl.[7] ..... A43B 7/06
(52) U.S. Cl. ..... 36/3 B; 36/29; 36/28
(58) Field of Search ..... 36/3 B, 29, 28

(56) References Cited

U.S. PATENT DOCUMENTS 825,515 A * 7/1906 Byrne et al. ..... 36/3 B
878,039 A * 2/1908 Bullard ..... 36/153
1,044,015 A * 11/1912 Byrne ..... 36/147
1,128,220 A * 2/1915 Bullard ..... 36/3 B
3,716,930 A * 2/1973 Brahm ..... 36/3 B
4,635,385 A * 1/1987 Ogden ..... 36/3 B
5,333,397 A * 8/1994 Hausch ..... 36/3 B
5,584,130 A * 12/1996 Perron ..... 36/3 B
6,041,519 A * 3/2000 Cheng ..... 36/29

* cited by examiner

*Primary Examiner*—Ted Kavanaugh
(74) *Attorney, Agent, or Firm*—Kirschstein, et al.

(57) ABSTRACT

A shoe insole has a plurality of superimposed, thin, apertured, mesh and/or fabric layers at its front end region, and a heel-operated pump for pumping air through openings in the apertured layers. The layers occupy a minimal height and easily fit within footwear having a low overhead toe region.

10 Claims, 3 Drawing Sheets

VENTILATED SHOE INSOLE HAVING MINIMAL HEIGHT FRONT REGION

BACKGROUND OF THE INVENTION

1. Field of the Invention

The present invention generally relates to shoes, especially athletic shoes, and, more particularly, to a ventilated insole having a minimal height in a front region of the insole.

2. Description of the Related Art

Air circulation, especially in an enclosed toe region of a shoe, is often inadequate to properly deal with the dual problems of accumulating moisture (sweat) and odor at the affected region not only when the shoe is used for normal day-to-day activities, but also when the shoe is used for strenuous activities such as sports. Attempts to address these problems by using permeable, breathable fabrics and insoles having on-board pumps capable of pumping air are disclosed, for example, in U.S. Pat. Nos. 2,441,879; 2,668,372; 4,654,982; 4,760,651; 4,974,342 and 5,282,324.

Experience has shown, however, that the known ventilated shoes have not proven to be altogether satisfactory. In order to deliver fresh air to the toe region, air channels were created within and under front portions of an insole. These air channels occupied a non-negligible amount of height for which many shoes simply did not provide sufficient toe room. To minimize this height and space requirement for the air channels, the air channels could be reduced in height. However, this decreased the air flow therethrough and could even block airflow if the air channels were folded during walking or running.

Also, many known ventilated shoes employed a foot-operated pump in which virtually the same volume of drawn-in air was discharged. If a small volume of air was drawn into the pump, one must repeatedly activate the pump for adequate ventilation. There are times, however, when such repeated activity is not desired or possible.

SUMMARY OF THE INVENTION

OBJECTS OF THE INVENTION

Accordingly, it is a general object of this invention to advance the state of the art of ventilated insoles and shoes.

More particularly, it is an object of the present invention to effectively and adequately ventilate a shoe.

Still another object of the present invention is to provide a ventilated insole of minimal height to fit inside shoes, even with low overhead toe room.

It is yet another object of the present invention to use a small volume of air to entrain and accelerate a larger volume of air to effect ventilation.

A still further object of the present invention is to keep one's foot drier and to remove moisture and odor from shoes.

FEATURES OF THE INVENTION

In keeping with the above objects and others which will become apparent hereafter, one feature of the present invention resides, briefly stated, in a ventilated shoe insole extending between a heel region and a toe region. The insole has a top apertured layer and a bottom apertured layer superimposed at the toe region. Each of the apertured layers has a multitude of openings extending therethrough. The insole also has a pump at the heel region and connected to the apertured layers. The pump has an inlet into which air is drawn during use of the pump, and an outlet from which drawn-in air is discharged through the openings in the apertured layers.

The apertured layers occupy a minimal combined height. Preferably, at least one of the layers, if not a plurality of the layers, is constituted of a thin, flexible mesh or of a fabric. Two apertured layers, and even up to six to eight apertured layers for increased performance, can be superimposed and still fit easily inside shoes, even those having low overhead toe room. Air channels of appreciable height, as taught by the prior art discussed above, have been eliminated.

In the preferred embodiment, a base layer is connected to the apertured layers, and the pump is supported on the base layer. The pump includes an elongated conduit connected at one end region to the pump, and at an opposite end region to the outlet. The pump includes a pumping chamber and a resilient element mounted in the chamber. The resilient element has a plurality of dome-shaped hollow protuberances bounding voids interconnected in air flow communication with one another. The resilient element has connecting channels for interconnecting the voids. The pump is sandwiched between the apertured layers and the base layer at the heel region. The bottom apertured layer has an underside, and the outlet is positioned below the underside of the bottom apertured layer. The base layer includes a plurality of channels in air flow communication with the outlet. Air within the channels is entrained by, and discharged with, the air discharged from the outlet during use of the pump. The entrained air provides for a greater volume of ventilation air than would be achieved by the pump only delivering the drawn-in air.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
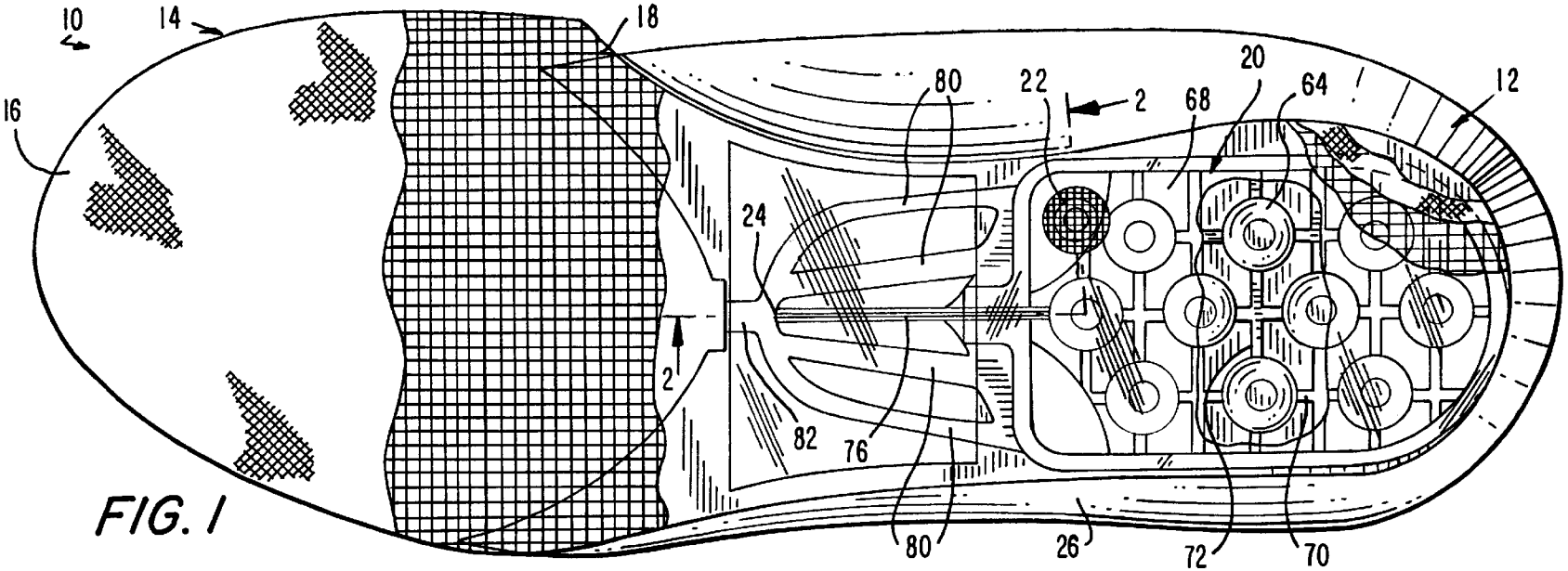
FIG. 1 is a broken-away, top plan view of an insole according to one embodiment of this invention.
Figure 2:
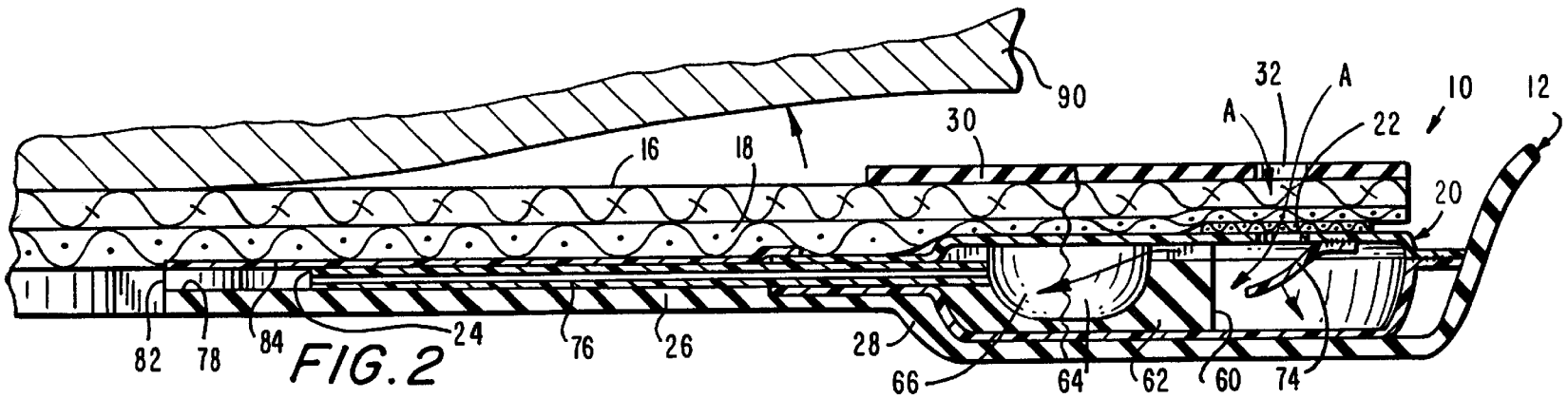
FIG. 2 is a sectional view taken on line 2—2 of FIG. 1 in one operating position of a pump.
Figure 3:
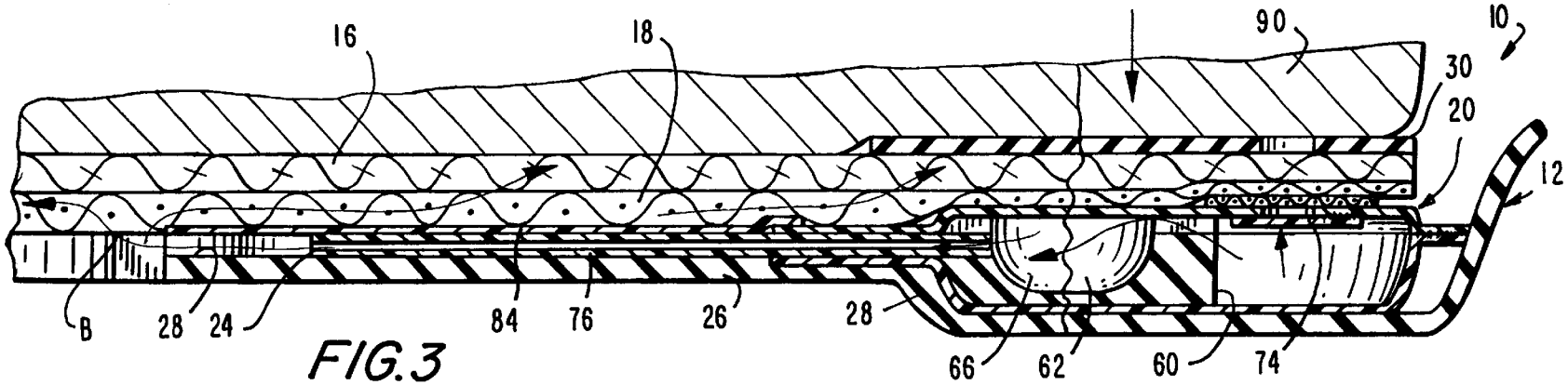
FIG. 3 is analogous to FIG. 2, but in another operating position of the pump.
Figure 6:
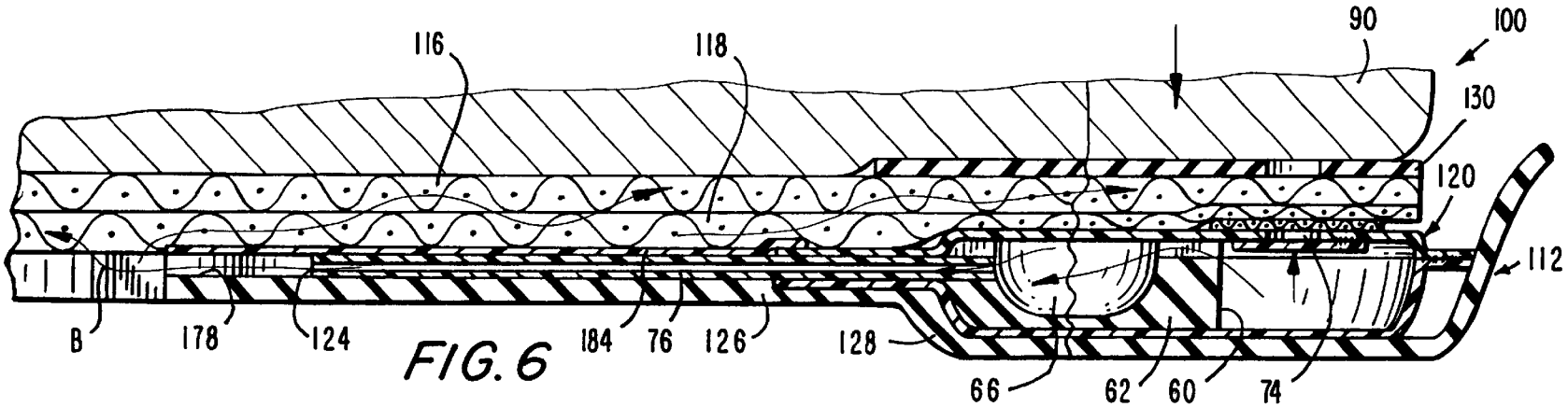
FIG. 6 is analogous to FIG. 5, but in another operating position of the pump.
Figure 4:
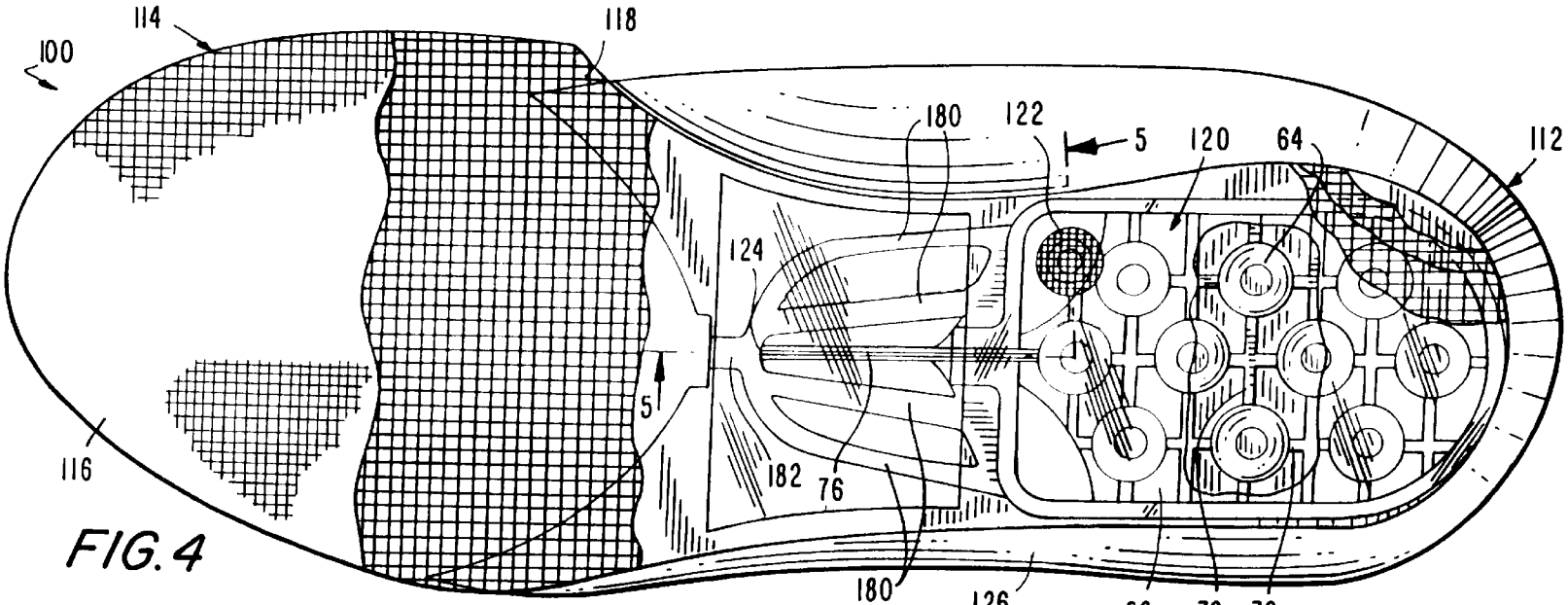
FIG. 4 is a broken-away, top plan view of an insole according to another embodiment of this invention.
Figure 5:
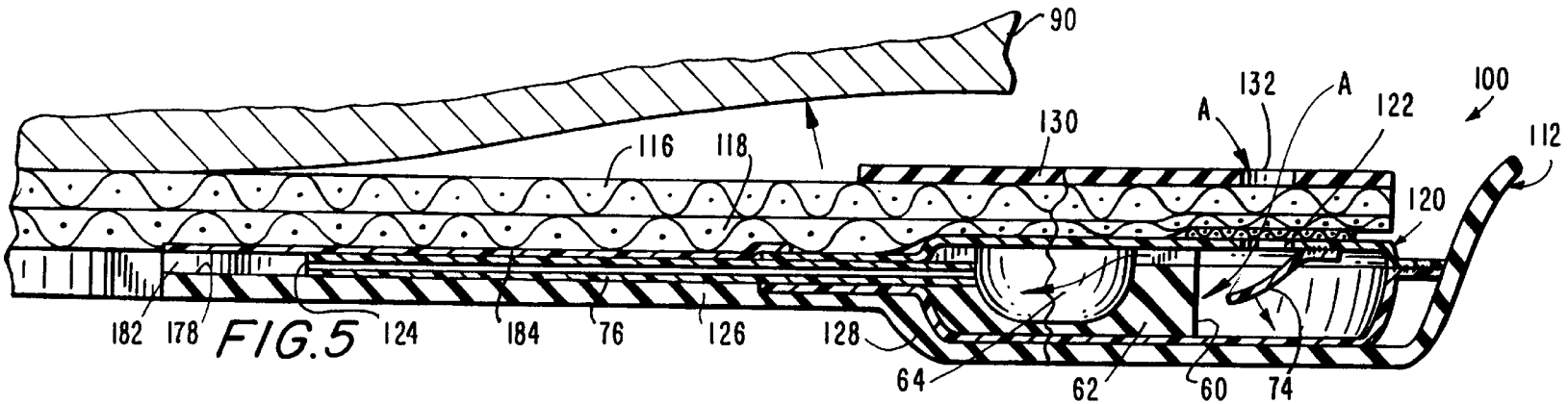
FIG. 5 is a sectional view taken on line 5—5 of FIG. 4 in one operating position of a pump.

Reference numeral 10 in FIGS. 1–3 identifies a first embodiment of an insole, and reference numeral 100 in FIGS. 4–6 identifies a second embodiment of an insole, according to this invention.

Insoles 10, 100 extend between heel regions 12, 112 and toe regions 14, 114, respectively. Insoles 10, 100 respectively have top apertured layers 16, 116 and bottom apertured layers 18, 118 superimposed at the toe regions 14, 114.

Insoles 10, 100 respectively have pumps 20, 120 at the heel regions 12, 112 connected to the apertured layers 12, 14 and 112, 114. Pumps 20, 120 have respective inlets 22, 122 through which air is drawn in the direction of arrows A (see FIGS. 2 and 5), and outlets 24, 124 from which the drawn-in air is discharged in the direction of arrows B (see FIGS. 3 and 6).

Apertured layers 18, 116, 118 are each constituted of a thin, flexible mesh, preferably of synthetic plastic material for shape retention. Each layer is on the order of a few thousandths of an inch in thickness (height). The mesh has a multitude of openings (see checkerboard pattern in FIGS. 1 and 4) each of which can have any configuration in top plan view, e.g., square, circular, hexagonal. Each opening extends entirely through the mesh to allow air to pass freely therethrough.

Apertured layer 16 is constituted of a thin, flexible fabric, preferably of cloth, and also on the order of a few thousandths of an inch in thickness. The fabric, preferably woven, has a multitude of interstices or openings extending entirely therethrough to allow the free passage of air.

Either the top layer or the bottom layer, or both, can be constituted of the mesh, or of the fabric, or of a combination of the two. Although only two apertured layers are shown in the drawings, this was done so as not to unduly encumber the drawings. In some applications, more than two apertured layers, for example from six to eight in number, can be superimposed at the toe region, and still the resulting assembly has a minimal combined height which occupies very little space in a toe region of a shoe. Preferably, the top and bottom layers are joined together along their respective peripheries by a hot melt adhesive.

Insoles 10, 100 further respectively have base layers 26, 126 connected to the apertured layers, again preferably by a hot melt adhesive. Each base layer is constituted of a flexible, cushioned, foam sheet material and has a well 28, 128 into which the pumps 20, 120 are received and fixed in position, again preferably with a hot melt adhesive.

Insoles 10, 100 further respectively have optional cover layers 30, 130 of cushioned sheet material for comfort. Each cover layer overlies and is secured to the top apertured layer only at the heel region. Each cover layer has a hole 32, 132 in alignment with the pump inlets 22, 122.

Pumps 20, 120 are of identical construction and each includes a pumping chamber 60 into which a pumping element 62 is accommodated. Pumping element 62 has a plurality of dome-shaped, spaced-apart, protuberances 64 bounding air-filled voids 66. The protuberances are interconnected by a connecting portion 68, and are arranged along linear rows and linear columns orthogonal to the rows. As shown, the protuberances in one row are staggered relative to an adjacent row for increased packing density. Linear longitudinal channels 70 connect the voids in each row of protuberances. Linear transverse channels 72 connect the voids in each column of protuberances.

Each pump includes a flap valve 74 movable between a closed position (FIGS. 3 and 6) in which the valve covers the pump inlet, and an open position (FIGS. 2 and 5) in which the valve is remote from the pump inlet. Each pump includes an elongated conduit 76 centrally disposed on the insole and having one end connected to the pump, and an opposite end connected to the outlets 24, 124. As shown, each conduit 76 lies on the base layers 26, 126 and in a central channel 78, 178 formed in the base layers to prevent the conduit from displacement. A plurality of air channels 80, 180 (see FIGS. 1 and 4) is also provided in the base layers and straddle the central channel. All of the channels 78, 80 and 178, 180 lead to common discharge ports 82, 182. A cover sheet 84, 184 overlies the conduit, the discharge port and all the channels in the respective base layers.

Reference numeral 90 represents a foot raised above the pump (FIGS. 2 and 5) and pressing down against the pump (FIGS. 3 and 6) during walking and running. In use, as the heel of the foot is raised, a first volume of air is drawn through inlets 22, 122 in the direction of arrows A past valve 74 which has been opened due to an under-pressure condition within the voids 66. As the heel of the foot is lowered, the valve 74 closes, and the protuberances 64 are compressed, thereby creating an over-pressure in the voids and expelling the previously drawn-in air in the voids 66 through the conduit 76, the pump outlets 24, 124, and the discharge ports 82, 182 in the direction of the arrows B.

A second volume of air within the air channels 80, 180 is entrained by the expelled air from the voids and is commonly discharged as a ventilating air stream through the discharge ports. The air stream flows forwardly toward the toe region and upwardly through the openings and between the apertured layers following the path of least resistance. As the foot is again raised, the compressed protuberances return to their initial dome-shaped configurations due to their inherent resilience, and create the under-pressure condition in the voids to repeat the pumping action. To enhance the resilience of the pumping element, it is advantageously made of an elastomeric material.

The insole may be manufactured as a stand-alone item, or may be incorporated in a finished shoe.

It will be understood that each of the elements described above, or two or more together, also may find a useful application in other types of constructions differing from the types described above.

While the invention has been illustrated and described as embodied in a ventilated shoe insole having minimal height front region, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

I claim:

1. A ventilated shoe insole, comprising:

a) a top apertured layer and a bottom apertured layer superimposed on each other, the top and bottom layers respectively having upper and lower toe portions overlying each other and together constituting a minimal height toe region having a predetermined height, the top and bottom layers also respectively having upper and lower heel portions overlying each other at a heel region, and the upper and lower toe portions respectively having multitudes of openings overlying one another and being in open, constant, free, air flow communication with one another at the toe region;

b) a base layer lying underneath, and connected to, the heel portions and together constituting the heel region with a height greater than said predetermined height, the base layer extending from the heel region but terminating short of the toe region so as not to block the air flow communication at the toe region; and c) a pump sandwiched between the heel portions and the base layer at the heel region, the pump having an inlet into which air is drawn, and an outlet positioned below the bottom layer for discharging drawn-in air underneath the bottom layer and through the overlying openings at the toe region.

2. The shoe insole of claim 1, wherein the base layer is constituted of a flexible, cushioned sheet material.

3. The shoe insole of claim 1, wherein each of the apertured layers is a thin, flexible mesh constituted of a synthetic plastic material.

4. The shoe insole of claim 1, wherein one of the apertured layers is a mesh constituted of a synthetic plastic material, and the other of the apertured layers is constituted of a fabric material having interstices.

5. The shoe insole of claim 1, and further comprising a cover layer overlying the pump, the cover layer having a hole in alignment with the inlet.

6. The shoe insole of claim 1, wherein the pump includes an elongated conduit connected at one end region to the pump, and at an opposite end region to the outlet.

7. The shoe insole of claim 1, wherein the pump includes a pumping chamber and a resilient element mounted in the chamber, and wherein the resilient element has a plurality of dome-shaped hollow protuberances bounding voids interconnected in air flow communication with one another.

8. The shoe insole of claim 1, wherein the base layer includes a plurality of channels in air flow communication with the outlet, and wherein air within the channels is entrained by, and discharged with, the air discharged from the outlet during use of the pump.

9. The shoe insole of claim 8, wherein the pump includes an elongated conduit connected at one end region to the pump, and at an opposite end region to the outlet, and wherein the channels are positioned at opposite sides of the conduit.

10. The shoe insole of claim 1, wherein the apertured layers have respective peripheral edge regions joined together.

* * * * *